US007443144B2

(12) United States Patent
Uguen

(10) Patent No.: US 7,443,144 B2
(45) Date of Patent: Oct. 28, 2008

(54) VOLTAGE REGULATION SYSTEM COMPRISING OPERATING CONDITION DETECTION MEANS

(75) Inventor: Emeric Uguen, La Fresnaye au Sauvage (FR)

(73) Assignee: NXP B.V., Eindhoven (NL)

( * ) Notice: Subject to any disclaimer, the term of this patent is extended or adjusted under 35 U.S.C. 154(b) by 197 days.

(21) Appl. No.: 10/545,177

(22) PCT Filed: Apr. 5, 2004

(86) PCT No.: PCT/IB2004/001155

§ 371 (c)(1),
(2), (4) Date: Aug. 10, 2005

(87) PCT Pub. No.: WO2004/092861

PCT Pub. Date: Oct. 28, 2004

(65) Prior Publication Data

US 2006/0192542 A1 Aug. 31, 2006

(30) Foreign Application Priority Data

Apr. 16, 2003 (FR) ..... 03 50111

(51) Int. Cl.
*G05F 3/16* (2006.01)

(52) U.S. Cl. ..... 323/224; 323/286

(58) Field of Classification Search ..... 323/312–316, 323/272–276, 303, 224, 226, 284–286; 307/296, 307/296.8; 330/252, 69; 327/85, 86, 513
See application file for complete search history.

(56) References Cited

U.S. PATENT DOCUMENTS 5,262,712 A * 11/1993 Klotzig et al. ..... 323/224
5,485,077 A * 1/1996 Werrbach ..... 323/286
6,218,819 B1 4/2001 Tiwari

FOREIGN PATENT DOCUMENTS

WO WO 02/47025 6/2002

* cited by examiner

*Primary Examiner*—Rajnikant B Patel

(57) ABSTRACT

The invention relates to a system for generating an output voltage (Vout) from an input voltage (Vup), said system comprising:—regulation means (T1) for regulating said output voltage (Vout) to a target voltage level (Vcons), said regulation means (T1) comprising a control terminal intended to receive a regulation signal (SR) and an output terminal for delivering said output voltage (Vout),—first control means (COMP1) for delivering a first control signal (SC1) from a comparison between said regulation signal (SR) and a first reference signal (Vref1).

5 Claims, 4 Drawing Sheets

VOLTAGE REGULATION SYSTEM COMPRISING OPERATING CONDITION DETECTION MEANS

FIELD OF THE INVENTION

The invention relates to a system for generating an output voltage from an input voltage.

The invention has a number of applications in appliances using smart cards.

BACKGROUND OF THE INVENTION

In order to exchange data in a unidirectional or bidirectional manner, the smart cards require a regulated voltage supply Vout capable of delivering a certain current Iout, from an input voltage Vup. This supply, for which an embodiment is described in the FIG. 1, is generally delivered by an interface circuit contained in a smart-card reader.

The voltage supply which is delivered to the smart card is a stabilized supply whose output level is regulated to a certain value compatible with the characteristics of the smart card. In general, this regulation of the voltage allows to guarantee an output voltage equal to a target voltage Vcons, with a margin or error of a few percent.

In parallel, the supply to the interface circuit comprises control means to generate a change of state of a second control signal SC2 when the current flowing in the smart card exceeds a certain threshold value, for example to forewarn a possible short-circuiting in the smart card.

However, this interface circuit has functional limitations.

In normal operating conditions, the input voltage Vup must remain greater than the target voltage Vcons so that the regulation of the voltage is done correctly, and therefore a correct supply to the smart cards is guaranteed. If for any reason, the input voltage Vup just drops below the target voltage Vcons, then the output voltage Vout also drops without any control signal being generated. As this drop in voltage is not detected, it can be detrimental to the operation of the smart card or for the application using the smart card.

On the other hand, in case of a large drop of the input voltage Vup, the output current Iout which is flowing in the smart card is no longer significant as the smart card is no longer supplied by the correct output voltage Vout. The control means which generate the second control signal SC2 can then no longer play their role. If a short-circuit in the smart card occurs at this moment, the short-circuit has the risk of not being detected and runs the risk of deteriorating the application using the smart card.

OBJECT AND SUMMARY OF THE INVENTION

It is an object of the present invention to propose a system for generating a regulated output voltage Vout from an input voltage Vup and which makes an improved detection possible of the operating conditions of the voltage regulation.

For this purpose, the system according to the invention comprises:

- regulation means T1 for regulating said output voltage Vout to a target voltage level Vcons, said regulation means T1 comprising a control terminal intended to receive a regulation signal SR and an output terminal for delivering said output voltage Vout,
- first control means COMP1 for delivering a first control signal SC1 from a comparison between said regulation signal SR and a first reference signal Vref1.

By directly comparing the regulation signal SR to the first reference signal Vref1, a control signal SC1 is generated as soon as the voltage regulation done by the regulation means T1 becomes impossible. The first control signal SC1 therefore adopts an initial state when the regulation conditions are correct and a second state when the operating conditions for the regulation are no longer satisfied, in particular, when the input voltage Vup drops by a large amount with respect to the target voltage Vcons.

The detection of the operating conditions of the voltage regulation is only parametered by the value of the first reference signal Vref1. Such a system is therefore only dependent on the input voltage threshold Vup, and independent of the amplitude variations of Vup, which facilitates the regulation and the setting.

According to an additional characteristic, the system according to the invention has second control means COMP2 for delivering a second control signal SC2 from a comparison between a fraction Ik of the current Iout delivered by said regulation method T1 on said output terminal and a second reference signal Vref2.

This allows to generate a second control signal SC2 which indicates the operating conditions with regard to the value of the current Iout delivered by the voltage supply. The second control signal SC2 therefore adopts a first state when the output current Iout delivered by the voltage supply is of nominal value and a second state when the output current Iout exceeds a certain threshold depending upon the second reference signal Vref2.

The generation of the control signals SC1 and SC2 being independent of each other, an exceeding of the value of the output current Iout can be detected at the same time as a drop in the input voltage Vup occurs.

According to an additional characteristic, the system according to the invention comprises means P1-P2-T5 for deactivating the generation of said output voltage from said first control signal SC1 or said second control signal SC2.

Considering that a change of state of the control signals SC1 and SC2 characterizes the beginning of an abnormal operation of the system, that is, a very high drop of the input voltage Vup or a too high output current Iout, the control signals SC1 and SC2 are advantageously used to deactivate the generation of the output voltage Vout supplied to the smart card. This limits the risk of damage to the smart card and the application using the smart card.

The invention also relates to an interface circuit comprising a system according to the invention as described above for generating an output voltage Vout at a smart card, and a smart card reader comprising such an interface circuit.

The invention also relates to an integrated circuit comprising a system according to the invention as described above for generating an output voltage Vout from an input voltage Vup.

BRIEF DESCRIPTION OF THE DRAWINGS

The invention will be further described with reference to examples of embodiments shown in the drawings to which, however, the invention is not restricted. In the drawings.

DETAILED DESCRIPTION OF THE INVENTION

Figure 1:
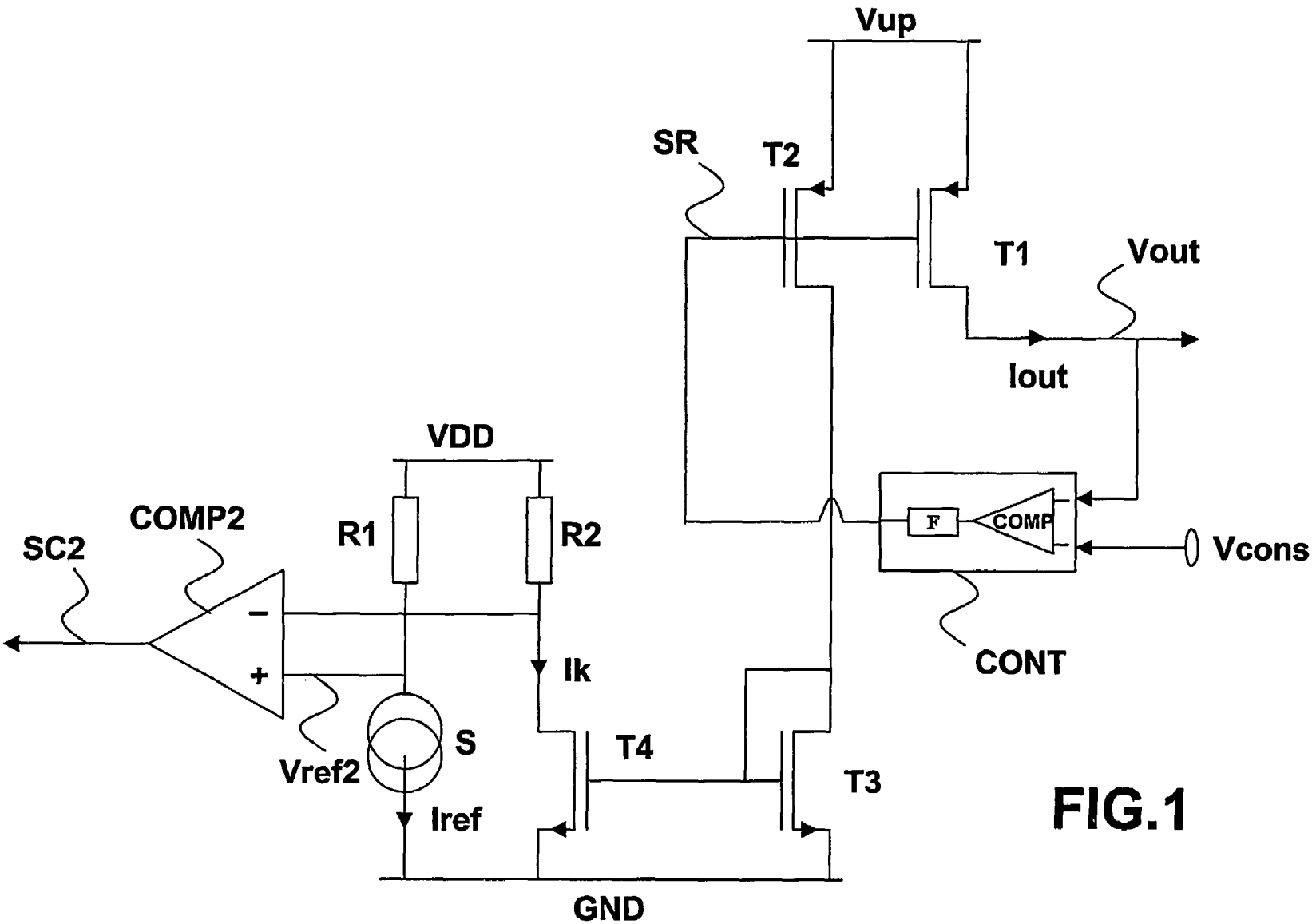
FIG. 1 describes a system for generating an output voltage Vout from an input voltage Vup and which allows to deliver a second control signal SC2 indicating an exceeding of the output current Iout, FIG. 2 describes a system according to the invention for generating an output voltage Vout from an input voltage Vup, and which allows to deliver a second control signal SC2 indicating an exceeding of the output current Iout, and a first control signal SC1 indicating a drop in the input voltage Vup, FIG. 3 describes a system according to the invention, which de-activates the generation of the output voltage Vout from the first and/or second control signals SC1-SC2.

FIG. 1 describes a system for generating an output voltage Vout from an input voltage Vup, and which allows to deliver a second control signal SC2 indicating an exceeding of the output current Iout. The output voltage Vout is in particular intended to supply a smart card (not shown).

The system comprises regulation means for regulating the output voltage Vout to a reference value given by a target signal Vcons. Depending upon the type of smart card used, the target signal Vcons can be fixed at 5V, 3V or 1.8V, with a maximum current Iout of 60 mA, 60 mA or 30 mA respectively.

The regulation means comprise a transistor T1, for example a MOS transistor, the transistor Ti having a gate defining a control terminal intended to receive a regulation signal SR, a drain defining an output terminal intended to deliver said output voltage Vout, and a source connected to the input voltage Vup. The regulation signal SR is generated by a control device CONT having two inputs for receiving, on the one hand, the output voltage Vout to be regulated and, on the other hand, the target signal Vcons. The control device thus generates a regulation signal SR corresponding to an error between the two input signals Vout and Vcons. For this purpose, the control device CONT comprises connected in series, a comparator COMP having two inputs and an low-pass output filter F guaranteeing the stability of the regulation loop formed by the elements T1-CONT. Such a regulation loop is known to a skilled person. When the output voltage Vout tends to be lower or higher than the set signal Vcons, the regulation signal SR varies in such manner as to bring back the output voltage Vout to the target value of the signal Vcons, by modifying the polarisation of the transistor T1 on its control terminal.

The system also comprises second control means COMP2 for delivering a second control signal SC2. The control means COMP2 perform a comparison between a fraction Ik of the current Iout delivered by the regulation means T1 on said output terminal to the smart card and a second reference signal Vref2. The second control means COMP2 correspond, for example, to a comparator with two inputs. The object of the second control signal SC2 is to indicate an abnormal exceeding of the output current Iout delivered to the smart card.

The fraction Ik of the current Iout is obtained by using a current mirror of the type known to the skilled person. The current mirror comprises the transistor T2 receiving at its gate the regulation signal SR, the transistors T3 and T4, and the resistance R2 connected to a voltage source VDD. The current mirror allows to deliver in the resistance R2 a current Ik satisfying the relation Ik=Iout/K, where K is the reduction factor determined by the characteristics of the transistors T2-T3-T4.

The second reference signal Vref2 corresponds to the node potential between a current source S and the resistance R1, the current source S giving a reference current Iref to the resistance R1 connected to the voltage source VDD.

The second control signal SC2 therefore adopts a first state when the current Iout delivered by the supply is lower than the threshold value defined by the relation (K*Iref*R1/R2), and a second state when the current Iout delivered by the supply is higher than said threshold value.

Figure 2:
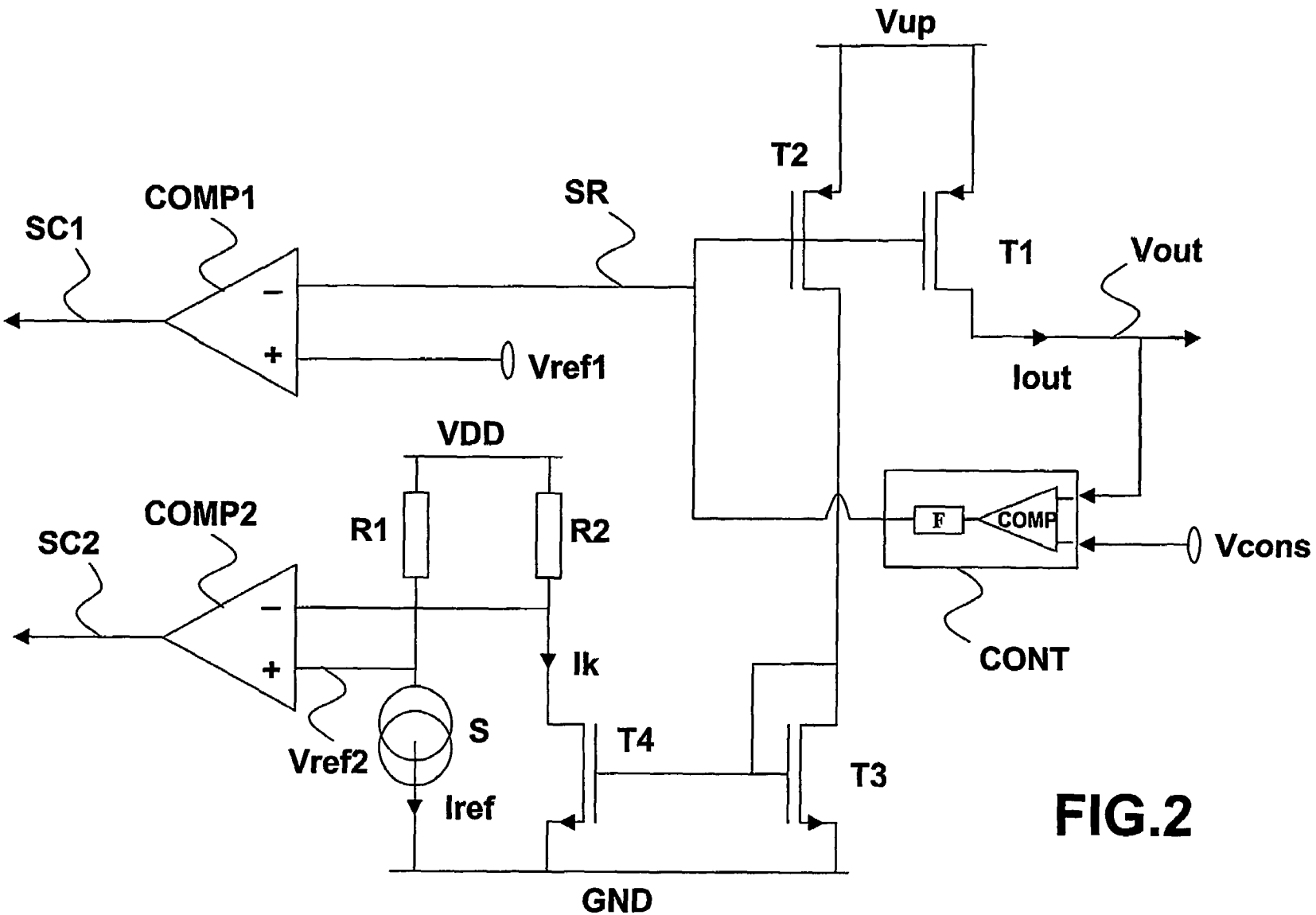

FIG. 2 describes a system according to the invention for generating an output voltage Vout from an input voltage Vup and which allows to deliver a second control signal SC2 indicating an exceeding of the output current Iout, and a first control signal SC1 indicating a drop of the input voltage Vup below a certain threshold.

In addition to the elements described in the FIG. 1, the system described in the FIG. 2 comprises first control means COMP1 for delivering a first control signal SC1. The first control means COMP1 perform a comparison between said regulation signal SR and a first reference signal Vref1. The first control means COMP1 correspond for example to a comparator with two inputs.

By directly comparing the regulation signal SR to the first reference signal Vref1, a first control signal SC1 is generated as soon as the voltage regulation executed by the regulation means becomes impossible, ie. when the input voltage Vup drops too much compared to the target signal Vcons.

When the input voltage Vup drops too much compared to the target voltage Vcons, even a regulation signal SR of a level close to a zero level rendering the MOS transistor T1 equivalent to a closed switch, it is not sufficient to obtain an output voltage Vout close to the target signal Vcons.

The drop of the input voltage Vup is therefore detected by fixing the first reference signal Vref1 at a value close to zero, for example 200 mV. In this manner, the first control signal SC1 adopts a first state when the regulation conditions are correct, ie. when the regulation signal SR is higher than Vref1, and the first control signal SC1 adopts a second state when the operating conditions of the regulation are no longer satisfactory, i.e. when the regulation signal SR is lower than Vref1.

The change of state of the first control signal SC1 therefore permits the detection of the malfunctioning of the regulation of the output voltage Vout.

The info contained in the first and second control signals SC1 and SC2 can thus be used advantageously to activate certain means at the application level, or thus inform the application using the smart card (for example the smart card reader) of the detection of a malfunctioning in the supply system to the smart card.

Figure 3:
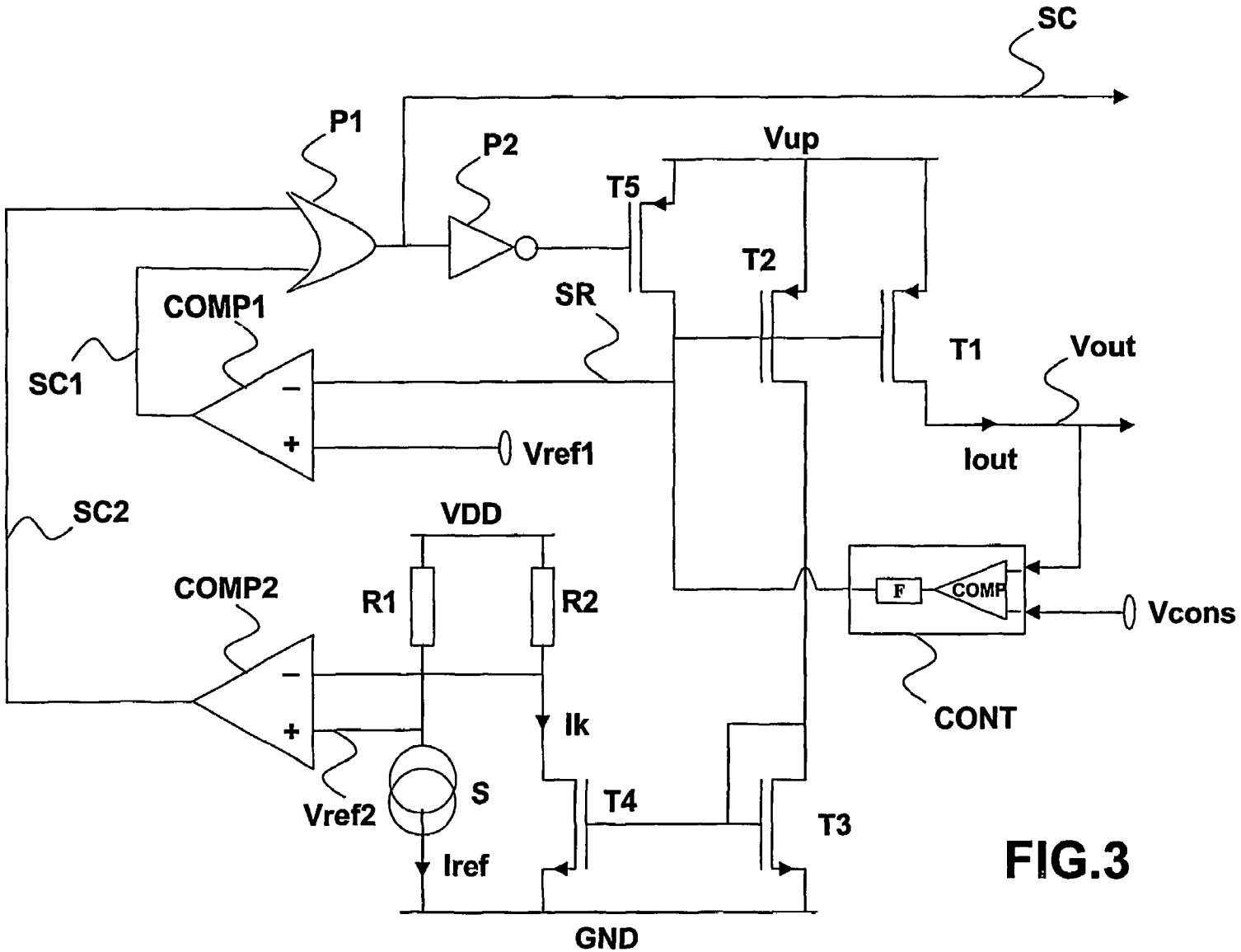

FIG. 3 describes a system according to the invention which permits the de-activation of the generation of the output voltage Vout from said first and second control signals SC1 and SC2.

In addition to the elements described in the FIG. 2, the system comprises a logic OR-gate P1 having two inputs and being intended to receive the first and second control signals SC1 and SC2, for generating an output control signal SC. The output control signal SC therefore indicates both a drop of the input voltage Vup and/or an exceeding of the output current Iout. This output control signal SC can be used to inform the application—for example the smart card reader—of a malfunctioning in the supply to the smart card. The signal SC can also be used to deactivate the generation of the output voltage Vout when a too important drop of the input voltage Vup occurs, or when the output current Iout is exceeded. For this purpose, the system comprises a logic gate P2 of the inverter type to reverse the output control signal SC, the output signal of the inverter P2 being connected to the gate of a MOS transistor T5. In addition, the transistor T5 has its source connected to the input voltage Vup and its drain connected to the gate of the transistors T1 and T2. Depending upon the level of the output control signal SC, the transistor is either equal to an opened switch or to a closed switch. When the transistor T5 is equal to an opened switch, it applies a bias voltage to the gates of the transistors T1 and T2 so that the regulated output voltage Vout is normally generated at the smart card. When the transistor T5 is equal to a closed switch, it applies a bias voltage to the gate of the transistors T1 and T2 so as to deactivate the generation of the output voltage Vout at the smart card.

Figure 4:
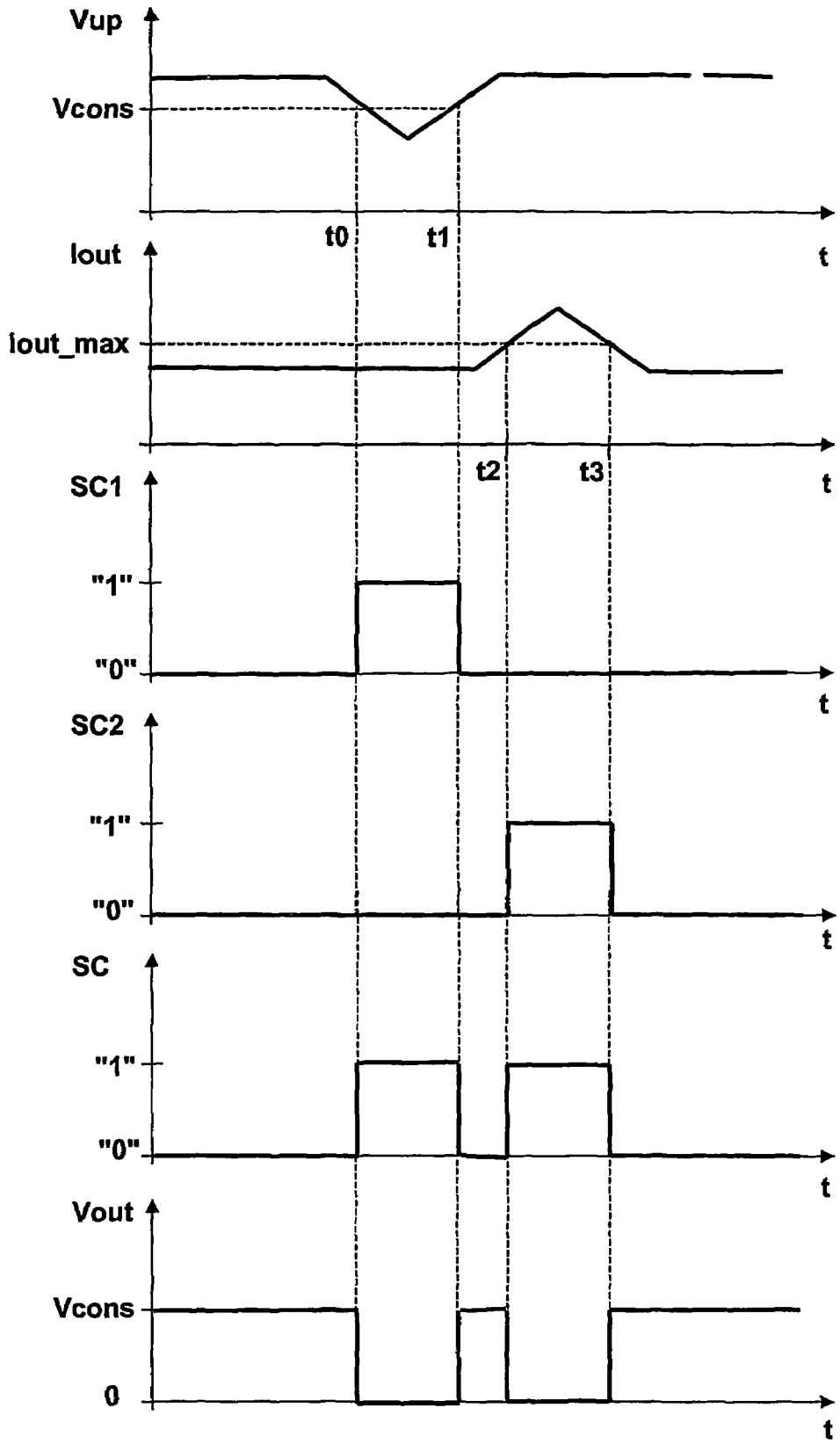
FIG. 4 illustrates temporal variations of the output voltage Vout as a function of the various control signals generated by the system according to the invention.

FIG. 4 illustrates the temporal variations of the output voltage Vout as a function of the various first and second control signals SC1 and SC2 generated by the system according to the invention.

Up to the instant t0, the input voltage Vup is higher than the target signal Vcons, so that, the voltage regulation can be carried out correctly. No exceeding of the output current Iout occurs. The first and second control signals SC1 and SC2 have the low logic level. The output voltage Vout is therefore regulated to the target signal level Vcons.

Between the instants t0 and t1, the input voltage Vup becomes lower than the target signal Vcons, so that, the voltage regulation can no longer be carried out correctly. This voltage drop is detected by means of the first control means COMP1 which then delivers a first control signal SC1 at a high logic level. The output control signal SC also moves to the high logic level, which closes the switch formed by the transistor T5. The output voltage Vout is then deactivated and its level moves to zero. The second control signal SC2 remains at the low logic level because during this period the current Iout has not been exceeded.

Between the instants t1 and t2, the input voltage Vup once again becomes higher than the set signal Vcons, so that, the voltage regulation can once again be carried out correctly. Therefore, the first control signal SC1 once again moves to the low logic level, whereas the second control signal SC2 remains at the low logic level because the output current Iout has not always been exceeded. The output control signal SC then moves to the low logic level, which opens the switch formed by the transistor T5. The output voltage Vout is therefore once again generated and regulated at the target signal level Vcons.

Between the instants t2 and t3, the output current Iout becomes greater than a threshold Iout_max defined by the relation Iout_max=(K*Iref*R1/R2). This exceeding of the output current Iout is detected by means of the second control means COMP2 which then delivers a second control signal SC2 at a high logic level. The output control signal SC then moves to the high logic level, which closes the switch formed by the transistor T5. The output voltage Vout is then deactivated and its level moves to zero. The first control signal SC1 remains at the low logic level, because during this period no drop of the input voltage Vup occurs.

Beyond the instant t3, the output current Iout once again becomes lower than the threshold current Iout_max, so that the power supply can once again be carried out without the risk of damaging the smart card. The second control signal SC2 once again moves to the low logic level, whereas the first control signal SC1 remains at the low logic level. The output voltage Vout is therefore once again generated and regulated at the target signal level Vcons.

The system according to the invention can be advantageously used in an interface circuit so that an output voltage Vout is generated to a smart card. In particular, the interface circuit can be implemented in a smart card reader.

The system according to the invention can also be used in an integrated circuit intended to communicate with a smart card and in particular intended to generate an output voltage Vout to a smart card from an input voltage Vup.

The invention claimed is:

1. A system for generating an output voltage from an input voltages, said system comprising:

regulation means for regulating said output voltage to a target voltage level, said regulation means comprising a control terminal that receives a regulation signal and an output terminal for delivering said output voltage;

first control means for delivering a first control signal from a comparison between said regulation signal and a first reference signal, the first control signal forming an indication that the regulation signal is outside a normal range; and second control means for delivering a second control signal from a comparison between a fraction of the current delivered by said regulation means on said output terminal and a second reference signal, the second control signal forming an indication that an output current is outside a normal range.

2. A system as claimed in claim 1 comprising means for deactivating the generation of said output voltage from said first control signal and/or said second control signal.

3. An interface circuit comprising a system as claimed in claim 1 for generating said output signal to a smart card.

4. A smart card reader comprising an interface circuit as claimed in claim 3.

5. An integrated circuit comprising a system as claimed in claim 1.

* * * * *